US006504311B1

(12) United States Patent
Kumar et al.

(10) Patent No.: US 6,504,311 B1
(45) Date of Patent: Jan. 7, 2003

(54) COLD-CATHODE CATHODOLUMINESCENT LAMP

(75) Inventors: Nalin Kumar, Canyon Lake, TX (US); Christo P. Bojkov, Austin, TX (US); Martin A. Kykta, Austin, TX (US)

(73) Assignee: SI Diamond Technology, Inc., Austin, TX (US)

( * ) Notice: Subject to any disclaimer, the term of this patent is extended or adjusted under 35 U.S.C. 154(b) by 1063 days.

(21) Appl. No.: 08/621,531

(22) Filed: Mar. 25, 1996

(51) Int. Cl.[7] ..... H05B 37/00
(52) U.S. Cl. ..... 315/169.3; 313/309; 313/310
(58) Field of Search ..... 315/169.3, 105, 315/160, 246, 250, 260, 271; 313/495, 496, 497, 326, 329, 351, 336, 309, 310

(56) References Cited

U.S. PATENT DOCUMENTS

| | | | | |
|---|---|---|---|---|
| 4,303,913 A | * | 12/1981 | Tohda et al. | 340/704 |
| 4,818,914 A | | 4/1989 | Brodie | 315/169.3 |
| 5,202,571 A | * | 4/1993 | Hirabayashi et al. | 257/10 |
| 5,210,430 A | * | 5/1993 | Taniguchi et al. | 257/103 |
| 5,254,905 A | | 10/1993 | Dunbar et al. | 313/495 |
| 5,341,063 A | * | 8/1994 | Kumar | 313/309 |
| 5,378,963 A | | 1/1995 | Ikeda | 313/495 |
| 5,442,256 A | * | 8/1995 | Moyer et al. | 313/496 |
| 5,473,218 A | * | 12/1995 | Moyer | 313/309 |
| 5,543,684 A | * | 8/1996 | Kumar et al. | 313/495 |
| 5,552,613 A | * | 9/1996 | Nishibayashi et al. | 257/10 |
| 5,602,439 A | * | 2/1997 | Valone | 313/310 |

OTHER PUBLICATIONS

Jones, R., "Hybrid Circuit Design and Manufacture," *Electrical Engineering & Electronics/12*, Sponsored by Int'l Soc. Hybrid Microelectronics, pp. 62–81, 1982.

Akinwande, A., et al., "Thin–Film–Edge Emitter Vacuum Microelectronics Devices for Lamp/Backlight Applications," Eighth Intl Vac. Elect. Conf., 1995, pp. 418–422.

* cited by examiner

*Primary Examiner*—David Vu
(74) *Attorney, Agent, or Firm*—Kelly K. Kordzik; Winstead Sechrest & Minick P.C.

(57) ABSTRACT

A pulsed lamp is supplied wherein electrons are supplied from a substantially flat cold cathode having low effective field emission work function and are accelerated to excite light emission from a phosphor layer on a transparent anode plate. The emission site density of the cathode and emission current characteristics vs electric field are selected to provide high light output while requiring only small duty cycle pulses from a voltage generator.

15 Claims, 2 Drawing Sheets

COLD-CATHODE CATHODOLUMINESCENT LAMP

BACKGROUND OF THE INVENTION

1. Field of the Invention

This invention relates to lamps or light sources. More particularly, a light source having a substantially planar cold-emission cathode as a source of electrons and a pulsed electrical potential between the cathode and a phosphor-coated anode is provided.

2. Description of the Related Art

The efficiency of electric lamps using filaments has not increased significantly for many years. Fluorescent discharge lamps are more efficient, but have other limitations which have been difficult to remove.

Cathodoluminescent lamps have been known for several years. They originally employed thermionic cathodes. U.S. Pat. No. 4,818,914 provided an improvement in cathodoluminescent lamps based on a field emission cathode. A layer of phosphor on an anode is located inside an envelope along with the field emission cathode, which is placed opposite the phosphor layer. A voltage source, either DC or AC, is connected across the cathode and accelerator electrodes to cause field emission of electrons from tips of needle-like members. A higher voltage is connected across the cathode and an anode for attracting electrons to the phosphor layer and exciting the phosphor to luminescence.

A thin-film-edge field emitter in a two-dimensional array of microstructures placed opposite a cathodoluminescent phosphor screen has been suggested as a backlight in Active Matrix Liquid Crystal Displays (AMLCD) ("Thin-film-edge emitter vacuum microelectronics devices for lamp/backlight applications," Eighth International Vacuum Electronics Conference, Portland, Jul. 30, 1995, p. 418–422.) It is suggested that such field emitter arrays can potentially satisfy the brightness, power efficiency and dimability requirements for AMLCD backlights. Such emitters would be used with high voltage phosphors so as to achieve the high brightness and long phosphor lifetime needed.

Backlighting is generally necessary in all Liquid Crystal Displays (LCDs). Such displays are used in televisions, lap-top computers, and various types of aircraft and automotive displays. The backlight in these systems is normally provided from a miniature fluorescent lamp. In many of these applications the backlight is the largest single consumer of power in the display system. For example, in a lap-top computer, the backlight will consume approximately 40 percent of the total power and the fluorescent lamp providing the backlight consumes a large fraction of that power. There is clearly a need for high efficiency lamps for such applications. In aviation and automobile displays, there is a need for a light source that can be dimmed and that will operate at low temperature without requiring auxiliary heat, that has quick startup, and that does not fail catastrophically. For other types of displays and light sources, such as projectors, a high brightness is needed. In some applications it is important to have the capability to scale-up the size of the source to provide the total light output needed. In all light sources, there is a need for a simple and efficient source and a source that does not cause potential environmental pollution, such as from the mercury that is present in fluorescent tubes. As in any device, a long lifetime is also desired.

SUMMARY OF THE PRESENT INVENTION

A cathodoluminescent lamp is provided having a flat cold cathode. The cathode has a low effective field emission work function. In one embodiment, the cathode surface is made of a carbonaceous coating which may be formed by laser ablation. In other embodiements, the cathode is formed by chemical vapor deposition or other methods. In a preferred embodiment, high voltage pulses having a low duty cycle are used to create the electric field between the cathode and an anode having phosphors adjacent to a transparent electrical conductor. In other embodiments, the cathode is comprised of separate areas having low effective field emission work function or the anode is comprised of separate areas of a a phosphor-coated anode. Mixtures of phosphors may be used.

A method for forming a lamp is disclosed. The method includes supplying a transparent anode coated with phosphor and a flat cathode having low effective field emission work function and encapsulating the electrodes and phosphor in an evacuated envelope. High voltage, by, preferably in the form of pulses, is then supplied between the electrodes.

BRIEF DESCRIPTION OF THE DRAWINGS

A better understanding of the present invention can be obtained when the following detailed description of the preferred embodiment is considered in conjunction with the following drawings, in which.

DESCRIPTION OF THE PREFERRED EMBODIMENT

Figure 1:
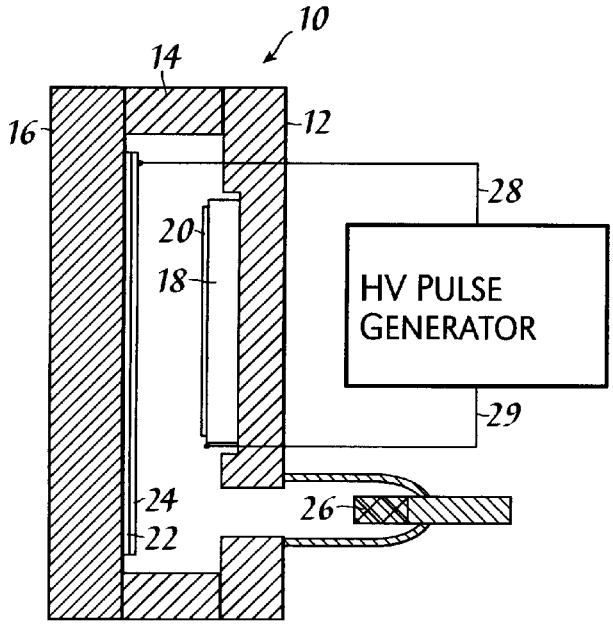
FIG. 1 is a schematic of one embodiment of the invention and associated electronics.

Referring to FIG. 1, lamp assembly 10 includes base 12, transparent plate 16, and spacers 14. These elements form a structure which can maintain high vacuum. Seals at the interfaces with spacers 14 may be any conventional vacuum tube seals such as glass frit or epoxy. Base 12 may be formed from metal, ceramic or transparent glass or ceramic material. Transparent plate 16 is preferably a glass having a high thermal conductivity, such as borosilicate glass.

Substrate 18 supports cathode 20. Substrate 18 may be silicon, molybdenum or glass. Cathode 20 has a cold-electron-emitting surface with low effective field emission work function. A low effective field emission work function material is defined as any material having a threshold electric field for electron emission of less than 50 Volts/micrometer. The emitting surface may be prepared by first growing on substrate 18 a metal layer. Any metal normally used in the semiconductor industry, such as molybdenum, tungsten, chromium, copper or aluminum, may be used. Preferably, a carbonaceous layer having low effective field emission work function is then deposited on the metal layer. If substrate 18 is sufficiently electrically conductive, the metal layer is not required. The carbonaceous coating may be a coating deposited by the laser ablation process described in U.S. Pat. No. 4,987,007, entitled "Amorphic Diamond Material Produced by Laser Plasma Deposition," incorporated by reference herein, or may be applied by a variety of chemical vapor deposition (CVD) processes, or by any other process which produces a low effective field emission work function surface. The cathode layer is selected to have high current output at low electrical field gradient and to have uniformity in emission over the surface with high emission-site density. It is intended that a flat cathode having a low effective field emission work function surface is included in the invention described herein.

Anode 22 is a transparent electrically conductive film such as indium tin oxide or tin oxide deposited on transparent plate 16. Phosphor layer 24 is deposited on anode 22 using known techniques such as electrophoresis or settling. The phosphors in phosphor layer 24 may be any phosphors used in cathode ray tubes; they preferably have high efficiency for light production. Phosphors used in layer 24 may individually produce different colors and may be mixed in a selected proportion to produce the desired spectral output from lamp assembly 10. Depending on the application of the lamp, the various phosphors may also be patterned in well defined configurations using standard methods used in CRT manufacturing. Suitable phosphors include: ZnS, Cu to produce green light; $Y_2O_2S$, Eu to produce red light; and ZnS, Ag to produce blue light. Preferably, phosphor layer 24 is covered with a layer of aluminum having a thickness of 5 to 50 nanometers (nm) which may be deposited by vapor deposition using known techniques such as sputtering or evaporation. Such layers are known in the art to provide reflection of light generated in phosphor layer 24 such that the light passes outward through plate 16 while causing negligible absorption of electrons emitted from cathode 20 and passing through the aluminum layer.

After the cathode and anode materials are in place, lamp assembly 10 is evacuated to a high vacuum and sealed. Getter 26 is then activated to remove remaining gases from inside assembly 10. Preferably the pressure in assembly 10 is reduced to less than $10^{-5}$ torr. The high vacuum is necessary to avoid positive ions forming in the gas and bombarding and destroying the cathode. Electrical leads 28 and 29 connect the anode and cathode respectively.

Operation of lamp assembly 10 preferably includes driving the diode assembly with high voltage pulses. The reason for driving the assembly with electrical pulses will be explained below. In operation, assembly 10 is connected to a high voltage, usually a pulse generator, which is adjusted to produce either positive or negative pulses having the desired voltage, frequency and pulse length (duty cycle) to produce light output at the desired level. Duty cycle of the pulses, defined as time-on divided by cycle time, is preferably less than 5 percent and more preferably is less than 1 percent. It is possible, however, to operate the lamp with DC voltage (100 percent duty cycle), but the lamp may suffer from problems as described in the following sections, particularly if the lamp is on for a significant time.

Voltage applied between the cathode and anode is in the range of 6 kilovolts to 30 kilovolts. Preferably voltage is in the range of 10 kilovolts to 12 kilovolts. Voltages higher than about 15 kilovolts may cause production of x-rays and should be avoided for this reason. The gap distance between cathode and anode is preferably in the range of 0.1 mm to 10 mm, but gap distance will be selected based on emission characteristics of the cathode and other factors as described below. Electric field in the gap will normally be in the range from about 1 volt per micrometer to about 50 volts per micrometer.

The design of a lamp according to the present invention begins with a selection of the light output desired. For example, assume that an output of 10,000 Ft-Lamberts of light is desired and that the efficiency of the phosphors that will be used is 20 Lumen per watt. The output of light is then about 11 Lumen per $cm^2$. Assume that a voltage of 10 kilovolts will be used. The electrical power input required is then 11 Lumen per $cm^2$ divided by 20 Lumen per watt, which is approximately 0.5 watt per $cm^2$. To produce this electrical power, the average electrical current density will be 0.5 watt per $cm^2$ divided by 10 kilovolts, or 50 microamps per $cm^2$. If one observes a graph of Emission Site Density (ESD, expressed in sites per $cm^2$) vs. electrical current for a low effective field emission work function cold cathode made of carbonaceous material, one sees that ESD is very low at such low current density. For a lamp, a high ESD is needed. For example, using data from a cathode discussed further below, if an ESD of 10,000 sites per $cm^2$ is desired, the current will be in the range of 10 millamps per $cm^2$. To bring the electrical power in line with requirements of 50 microamps per $cm^2$ and at the same time produce the high ESD needed for a lamp, the Duty Cycle of the electrical pulses driving the lamp must be 50 microamps divided by 10 milliamps, or 0.5 percent. For a frequency of pulses of 1 kHz, the pulse width would then be 5 microseconds.

From a graph of ESD vs. electrical field for the cathode material to be used, the electrical field to produce the desired ESD can be determined. At this electrical field, for the voltage of the pulses, the gap spacing between the cathode and anode can be determined.

The reason for application of high voltage pulses having a low duty cycle can best be understood by examination of curves showing current output versus electrical field and emission site density (ESD) of a diamond cold cathode as a function of electrical field gradient at the cathode. Such curves are provided in FIG. 2. The data represented in these curves are obtained by the following procedure: a flat cathode is placed in a vacuum cell and at a selected distance from a transparent anode. A DC voltage is applied and current through the gap is measured as a function of voltage. While voltage is applied, a magnified view of the anode is obtained, either by placing a microscope so as to directly observe the anode or by taking a high-resolution photograph of the anode. The number of points of light on the anode is then measured over the viewing area and the average density of light emission sites is calculated.

Figure 2:
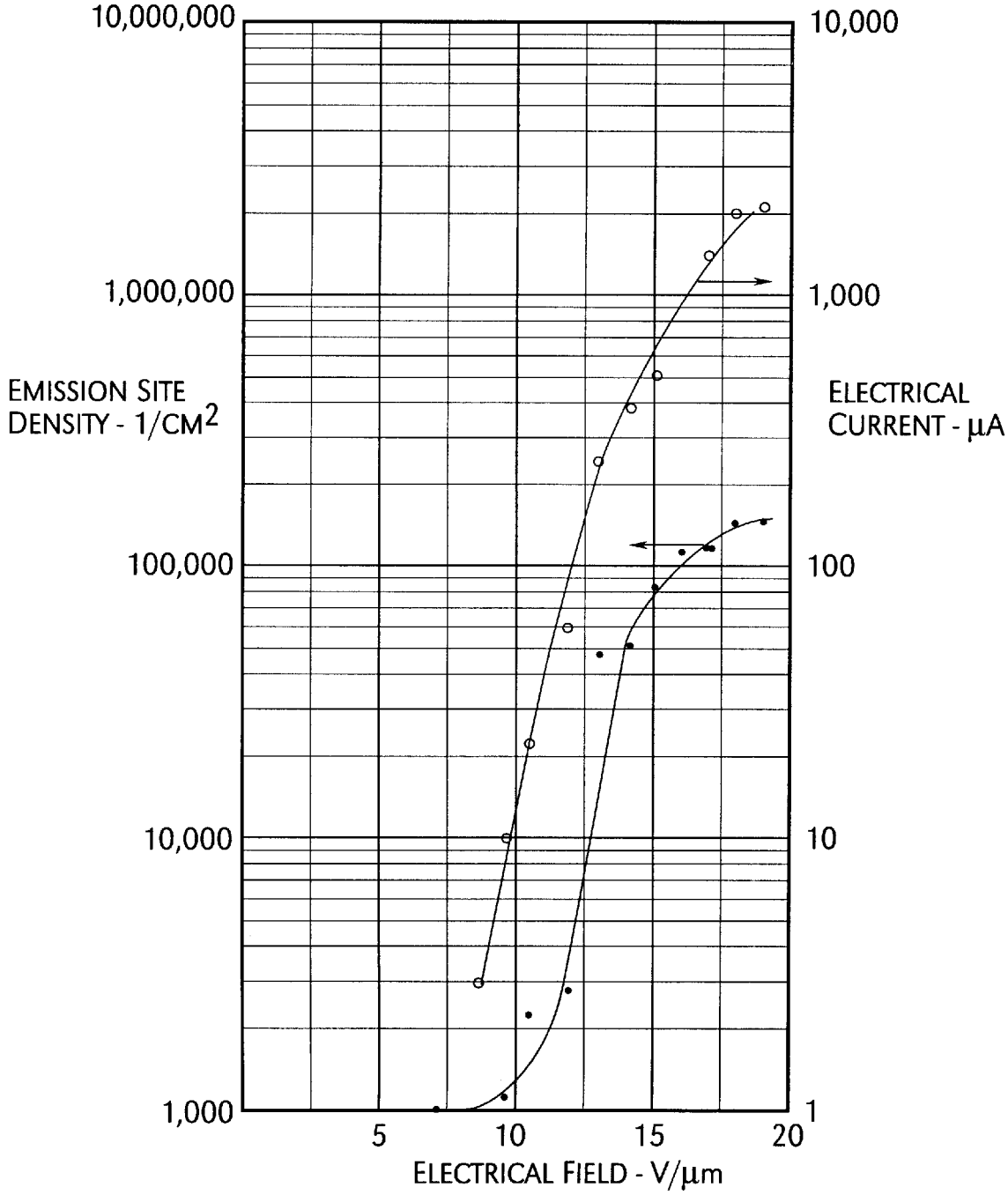
FIG. 2 is a graph of emission site density and electrical current vs. electrical field strength for a cathode of the device.

The data shown in FIG. 2 were obtained with a gap distance of 21 micrometers, an area of the cathode of 0.0035 $cm^2$, pulse width of 20 microseconds, pulse frequency of 60 Hz and an area of current collection of 6.35 $mm^2$.

Examination of the curves shows that driving the diode having the cold cathode at low electrical field strength produces only low emission site density. This results in low light output from a device using such cathode. Experiments have shown that at low site density "hot spots" are present on the cathode. This produces burning of the cathode and burning of the phosphor opposite the hot spot in the diode configuration. The solution to the problem of low site density or hot spots has been found to be the use of high-voltage pulses. Reference to FIG. 2 shows that at high voltage, the emission site density becomes orders of magnitude greater. For example, at an electrical field of 12 volts per micrometer the emission site density was about 2800 sites per $cm^2$. At a field of 15 volts per micrometer, the emission site density had increased to about 85,000 sites per $cm^2$. However, emission current had also become much larger—increasing from about 60 microamperes to about 500 microamperes. Power consumption of the diode under DC operation per $cm^2$ of area would be $[500\times10^{-6}\times10\ kV\times1/0.0035]$ 1.4 kilowatts, which would cause severe overheating at the electrodes in a short time and require too much power. It has been found, however, that the application of high voltage pulses at low duty cycle overcomes both the problem of low emission site density and excess power consumption at the electrodes. Neglecting capacitance losses, for example, with a duty cycle of 1 percent, the power requirement will be in the range of 14 watts.

Voltage of pulses and duty cycle are selected to produce the brightness desired from phosphor layer 24 of FIG. 1, keeping in mind the limitation of heating of the electrodes. A duty cycle of one percent or less can produce a bright lamp using presently available phosphors having normal efficiency. The frequency of the pulses may be in the range from about 20 Hz to about 20 MHz but is selected to produce a light output that is effective for the use intended. Excess flicker or variation in intensity can easily be avoided by increasing frequency of pulses. Preferably, pulse frequency is from about 1 Hz to about 10 kHz.

The gap distance between cathode and anode is selected based on emission characteristics of the cathode material. For the material having the properties shown in FIG. 2, a field gradient of at least about 10 volts per micrometer is necessary to reach an acceptable operating range. This would result in a required gap distance of 1 mm when using a pulse of 10 kV. Preferably, higher electrical current would be drawn from the cathode than the level at 10 volts per micrometer shown in FIG. 2. If a current corresponding to a field of 15 volts per micrometer were desired, for example, gap distance could be decreased to 0.66 mm for the material having properties shown in FIG. 2. Gap distance may be varied so as to allow operation of the diode in the desired emission site density range and current range for each cathode material selected, keeping in mind the upper voltage limitation to avoid x-ray production if such rays could cause problems in operation of the lamp.

Figure 3:
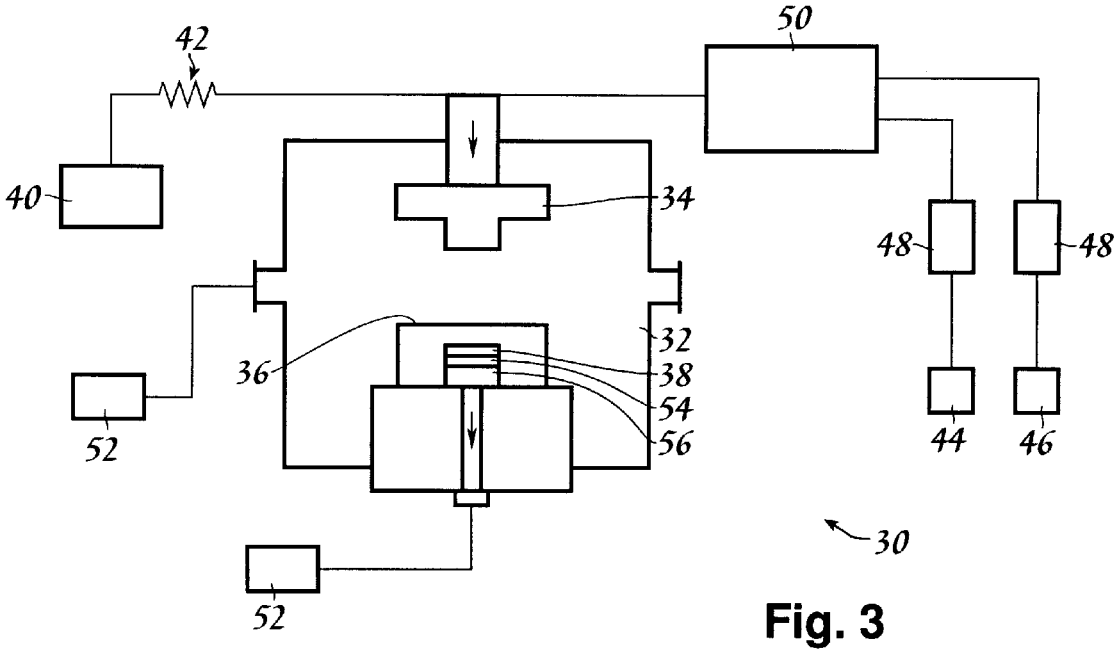
FIG. 3 is a schematic of apparatus used to form a preferred cathode for use in the invention.

The preferred cathode material, having current and emission site properties shown in FIG. 2, was prepared by apparatus shown in FIG. 3. First, a metal layer may be grown on a substrate wafer, using magnetron sputturing, if the wafer is not sufficiently conductive. (If it is made of glass, for example.) The wafer may then be placed in deposition system 30. Reactor 32, preferably made of stainless steel, encloses cathode 34, anode grid 36 and substrate 38. Cathode 34 may be mounted on a copper holder adapted for the circulation of cooling water. DC power supply 40 provides electrical power through resistor 42. Gases such as hydrogen and methane are supplied from containers 44 and 46 through electronic flow controllers 48 and buffer volume 50. A variety of gases may be used, including ethyl alcohol and other carbon-containing gases which are known to produce CVD diamond. Vacuum pumps 52 maintain a pressure of about 100 to about 300 torr when the gas flow rate is maintained in the range of about 500 standard $cm^3$ per minute (sccm) through reactor 32.

Substrate 38 is placed on substrate holder 54, which may also be a second anode 56, which is usually grounded. Substrate holder 54 may be electrically isolated from the second anode 56, so that substrate 38 is insulated from second anode 56, or both may be grounded. Substrate holder 54 also includes a heating element (not shown) to heat substrate 38, normally to a temperature in the range from 700° C. to about 1100° C. A preferred operating temperature is about 900° C. The surface of substrate holder 54 includes small openings connected to one of vacuum pumps 52 which hold substrate 38 in place by suction force. Water cooling is provided by flow in the center of substrate holder 54.

Substrate 38 may be seeded by standard procedure well known in the art and is then placed underneath grid 36 to position the substrate 38 "downstream" or out of the discharge region which will exist between cathode 34 and grid 36. By placing substrate 38 out of the plasma region, the glow discharge CVD technique can be used to grow diamond thin films on substrate 38 even if the substrate is an electrical insulator, such as glass. The distance between grid 36 and the surface of substrate 38 ranges between 0.1 and about 5 mm.

Grid 36 is formed as a mesh, preferably made from wire having a diameter of about 0.3 mm. The wire material used is preferably tungsten. The mesh includes a plurality of openings, each opening having a width of about 0.1 mm to about 5 mm and a length in about the same range of dimensions. Preferably, grid 36 is heated. Heating is achieved by the discharge current. The grid temperature is increased to above 1100° C. Grid 36 then behaves as a hot element to increase the diamond film growth rate on substrate 38. The high temperature also allows formation of film material having a structure which is effective as a cold cathode electron emitter. Preferably, the grid temperature should be above 1300° C. for effective cold electron emission and may be increased to as high as about 2500° C.

Cathode 34 may be formed from a metallic plate or from a porous metallic diaphragm. The tip of cathode 34 preferably has Rogovskey's Form, to provide a more homogenous electric field. The distance between cathode 34 and grid 36 is in the range from about 5 to 50 mm. A negative voltage is applied to cathode 34 while grid 36 is grounded. The voltage between grid 36 and cathode 34 is preferably In the range from about 600 volts to about 1200 volts. Ionization occurs in the gaseous column between the cathode and grid to form a discharge.

To form an effective cathode on a silicon substrate, wherein the silicon has conductivity sufficient not to require a metal layer, first, a film of silicon oxide on substrate 38 is etched or removed. This removal step occurs at a substrate temperature of about 900° C. with hydrogen in chamber 32 at a pressure of about 50 to 300 torr. In the second stage, methane is also admitted to chamber 32 to achieve a methane concentration from about 7% to about 12% along with the hydrogen. In this stage, silicon carbide is formed from the substrate surface. The step of forming the silicon carbide increases the adhesion of the diamond thin film to silicon substrate 38. Also, the silicon carbide layer improves electron ejection from the silicon substrate into the diamond films and increases electron emission from the diamond film grown during the third stage. In the third stage, polycrystalline diamond is grown on the surface. In this stage the methane concentration in the mixture is reduced to between about 3% to about 6%. The thickness of the film is increased to about 0.3 to about 2.0 micrometers. Finally, a step of annealing is added, in which only hydrogen is placed in the reactor and temperature is maintained for a period of about 5 to 15 minutes. To achieve greater uniformity in the emission from the surface, the substrate may be moved as the film is grown. The amplitude of movement is preferably at least as great as the distance between mesh wires of the grid anode being used. The frequency may be from about 1 Hz to about 100 Hz.

Cathodes prepared by the method described herein are then placed in apparatus as described above and tested for their emission properties. Variables may be adjusted to achieve optimum properties for the lamp design selected.

Figure 4:
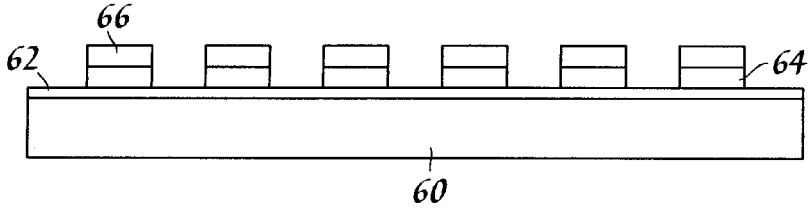
FIG. 4 is a schematic of the cathode structure showing an embodiment having an integral series resistor with the cathode.

Apparatus of FIG. 1 includes only one cathode surface. The size of this surface is limited by the area of low-effective field emission work function diamond or carbonaceous material that can be produced on a single surface. Production of wafers having low effective field emission work function diamond coatings up to about 10 inches in diameter is presently available for diamond made by laser ablation. For larger areas than available from one wafer, a plurality of cathode areas may be used. FIG. 4 shows such cathode. Also provided in FIG. 4 is a means to avoid the destructive effects of arcing from cathode to anode should arcing occur for any reason. Such arcing may be caused, for example, by gas evolving from phosphors or other materials in a lamp assembly.

Referring to FIG. 4, on substrate 60 is grown metal layer 62, using techniques well know in industry. Subsequently, on metal layer 62 has been grown resistor layer 64. Resistor layer 64 may be made up of a-Si, TiN, $TaN_x$, Ni—Cr or other known materials. Subsequently, on resistor layer 64, cathode 66 is provided. Cathode 66 is a low effective field emission work function material such as a diamond layer, such as discussed above.

Resistor 64 preferably has a resistance in the range of 1 to 100 megohms. The value of resistance is selected such that about 50 percent of the voltage drop under arcing conditions would occur across resistor 64. The preferred value of resistance increases as operating current through the cathode decreases. The benefit of resistor 64 is to decrease the risk of destruction of the cathode in the presence of arcing conditions. There may be an efficiency loss in the range of 10 percent to 50 percent from the presence of the integral resistor.

For large lamps, the sub-pixelation shown in FIG. 4 is particularly preferred. Each cathode area may be selected to be about one square centimeter, for example. The distance between adjacent cathode columns may be about 0.1 mm, for example. Such patterns may be formed by the methods of photolithography, using techniques well known in industry. These techniques are described, for example, in the book *Hybrid Circuit Design and Manufacture,* by R. D. Jones, pp. 62–80.

EXAMPLE

The cathode and anode of this invention were assembled in a vacuum chamber having transparent windows. A pulse generator was used to drive the device. At a voltage of 10 kilovolts and a pulse rate of 1000 Hz, with the duty cycle of the pulses being less than one percent, a light meter (Graseby Optronics, Model GO 352) was used to measure directly the light output from a phosphor area of 1 $cm^2$. The measurement was about 20,000 foot-Lamberts. The anode to cathode gap spacing was 1 mm. The phosphor was ZnS, Cu. The cathode was made of CVD diamond deposited on a silicon substrate using the glow discharge and hot filament method described above.

The invention has been described with reference to its preferred embodiments. Those of ordinary skill in the art may, upon reading this disclosure, appreciate changes or modifications which do not depart from the scope and spirit of the invention as described above or claimed hereafter.

What we claim is:

1. A cathodoluminescent lamp, comprising:

an evacuated envelope comprising a light-transparent area;

an anode in proximity to the light-transparent area;

a layer of phosphor in proximity to the anode;

a substantially flat cold cathode, the cathode comprising a substrate and a surface of low effective field emission work function with a resistive layer between the substrate and the surface of low effective field emission work function; and electrical connections to the anode and cathode.

2. The lamp of claim 1 wherein the surface of low effective field emission work function comprises a carbonaceous coating on the substrate.

3. The lamp of claim 2 wherein the carbonaceous coating is deposited by chemical vapor deposition.

4. The lamp of claim 2 wherein the carbonaceous coating is deposited by laser ablation.

5. The lamp of claim 2 wherein the carbonaceous coating comprises crystalline diamond.

6. The lamp of claim 1 wherein the flat cold cathode is comprised of a plurality of separate areas of low effective field emission work function on a substrate.

7. The lamp of claim 1 wherein the resistance of the resistive layer is in the range from about 1 megohm to about 100 megohms.

8. The lamp of claim 1 wherein the phosphor layer comprises a mixture of phosphor materials.

9. The lamp of claim 1 further comprising a layer of aluminum on the phosphor layer.

10. The lamp of claim 1 wherein the distance from the flat cold cathode to the anode is less than 5 mm.

11. The lamp of claim 1 further comprising a means for supplying a high voltage between said anode and cathode, said means connected to said electrical connections to the anode and cathode, and wherein said means for supplying high voltage supplies high voltage pulses, the pulses having a duty cycle in the range from about 0.1 percent to about 5 percent.

12. A cathodoluminescent lamp assembly, comprising:

an evacuated envelope comprising a light-transparent area;

an anode in proximity to the light-transparent area;

a layer of phosphor in proximity to the anode;

a substantially flat cold cathode, the cathode comprising a substrate and a surface of low effective field emission work function; and means for supplying a high voltage between the anode and the cathode, wherein the means for supplying high voltage supplies high voltage pulses, the pulses having a duty cycle in the range from about 0.1 percent to about 5 percent.

13. The lamp assembly of claim 12 wherein the high voltage supplied is greater than 6 kilovolts.

14. The lamp assembly of claim 12 wherein the cathode comprises a carbonaceous coating.

15. The lamp assembly of claim 12 wherein the phosphor layer comprises a mixture of phosphor materials.

* * * * *